US008109755B2

(12) United States Patent
Lawes

(10) Patent No.: US 8,109,755 B2
(45) Date of Patent: Feb. 7, 2012

(54) HAND TOOL FOR LAYING CONCRETE BLOCKS

(76) Inventor: Roland Lawes, Santiago (PA)

( * ) Notice: Subject to any disclaimer, the term of this patent is extended or adjusted under 35 U.S.C. 154(b) by 505 days.

(21) Appl. No.: 12/407,172

(22) Filed: Mar. 19, 2009

(65) Prior Publication Data

US 2010/0236007 A1 Sep. 23, 2010

(51) Int. Cl.
*E04G 21/20* (2006.01)

(52) U.S. Cl. ..... 425/456; 52/749.13; 249/53 M; 249/83; 425/472

(58) Field of Classification Search ..... 425/87, 425/432, 456, 472; 249/53 M, 83, 90, 105; 52/749.13
See application file for complete search history.

(56) References Cited

U.S. PATENT DOCUMENTS 889,943 A * 6/1908 Maddux ..... 425/87
1,478,776 A * 12/1923 Walker ..... 249/105
2,462,644 A * 2/1949 Kimura ..... 425/87
2,664,741 A * 1/1954 Nicholson ..... 249/53 R
3,371,459 A * 3/1968 Thomas et al. ..... 52/749.13
3,382,640 A * 5/1968 Thomas et al. ..... 52/749.14
3,799,714 A * 3/1974 Vetovitz ..... 425/456
3,999,920 A * 12/1976 Cerillo, Jr. ..... 425/447
5,125,814 A * 6/1992 Lester ..... 425/87

* cited by examiner

*Primary Examiner* — James Mackey
(74) *Attorney, Agent, or Firm* — Clifford Kraft

(57) ABSTRACT

A special hand tool for laying concrete blocks. The device includes a mini-hopper sized to hold the correct amount of mortar, a sluiceway, dimensioned to fill the normal joint space between blocks, an optional divider to accommodate both 4 inch and 8 inch nominal blocks, and a vibrator. The device has a handle that can also contain batteries for the vibrator. A mason can scoop up mortar while the tool is vibrating. When full, the vibrator can be stopped and the tool positioned to face the end of a block already set in a wall while the next block to be laid can be put in place on its mortar bed and pushed to the other face of the tool. The vibrator can then be re-started, and the tool vertically withdrawn leaving the mortar that was in the tool between the two block ends. The same tool can also be used to butter horizontal joints by running the vibrator only sufficiently to apply the correct amount of mortar. Alternatively, a second similar tool sized equal to the length of a block, containing exactly the right amount of mortar for a horizontal joint, can be used.

15 Claims, 3 Drawing Sheets

HAND TOOL FOR LAYING CONCRETE BLOCKS

BACKGROUND

1. Field of the Invention

The present invention relates generally to the field of concrete block construction and more particularly to a novel tool for laying concrete blocks.

2. Description of the Prior Art

Traditionally the tools used by masons to lay concrete blocks are the same as those designed to lay bricks. However, there is a considerable difference in laying bricks and laying concrete blocks. In particular, the method of "buttering" the block (that is putting mortar on it) is quite different.

A concrete block is a rectangular concrete structure known in the art that is made by pouring a particular type of concrete into a mold. Most concrete blocks have one or two open center regions that pass through the block from top to bottom. This is very different from a brick which is usually totally solid. A concrete block typically has end joints on the ends so that the blocks can be placed end-to-end to form a row. A concrete block must be buttered by putting a certain amount of mortar on one end. Each row, except the top row, is also buttered by putting mortar on the top of the row for the next row.

An experienced brick layer can shape and lay hundreds of bricks with very little spillage without ever letting go of the trowel. Concrete blocks, on the other hand, are too heavy to comfortably hold in one hand while cutting to size and laying to the line. Usually, after a block is cut to size, one end joint is buttered by placing the block on some surface with its end facing up. Alternatively, the block can be laid "bare" with the mason filling the joint after it is laid. Either way, the mason needs both hands to lay the block. When a block is placed in position, the mortar that protrudes from the wall surface is cut off with a trowel and either returned to the mortarboard, or used to butter the next block. Mortar that protrudes into the internal spaces cannot be cut off and is wasted.

The standard space between blocks is around ⅜ inch, so that a standard block plus joint space forms a wall section of 8×16 inches. The end joint space is sometimes measured; however, many times an experienced block layer can estimate the space correctly by eye.

Mortar as used in masonry has the property known in the art which causes it to set rapidly when it is motionless but become fluid when subject to sudden motion. With heavy concrete construction, vibrators are sometimes used to eliminate voids caused by unwanted setting.

Because of the inconvenience of setting concrete blocks with current methods and the amount of wasted mortar, it would be advantageous to have a hand tool that could facilitate quick laying of concrete blocks and provide exactly the correct amount of mortar.

SUMMARY OF THE INVENTION

The present invention relates to a special hand tool for laying concrete blocks. The present invention can lay a block with only four hand motions. The device includes a mini-hopper sized to hold the correct amount of mortar, a sluiceway, dimensioned to fill the normal joint space between blocks, an optional divider to accommodate both 4 inch and 8 inch nominal blocks, and a vibrator. The device has a handle that can also contain batteries for the vibrator. A mason can scoop up mortar while the tool is vibrating. When full, the vibrator can be stopped and the tool positioned to face the end of a block already set in a wall while the next block to be laid can be put in place on its mortar bed and pushed to the other face of the tool. The vibrator can then be re-started, and the tool vertically withdrawn leaving the mortar that was in the tool between the two block ends. The same tool can also be used to butter horizontal joints by running the vibrator only sufficiently to apply the correct amount of mortar. Alternatively, a second tool sized equal to the length of a block, containing exactly the right amount of mortar for a horizontal joint, can be used.

DESCRIPTION OF THE FIGURES

Attention is now directed to several illustrations that show various features of the present invention.

Several drawings and illustrations have been presented to aid in understanding the present invention. The scope of the present invention is not limited to what is shown in the figures.

DESCRIPTION OF THE INVENTION

The present invention relates to a specialized hand tool that makes quick and accurate laying of concrete blocks a reality. The present invention applies a measured amount of mortar to a concrete block to either form the end joint or form a mortar bed for a horizontal joint.

Figure 1:
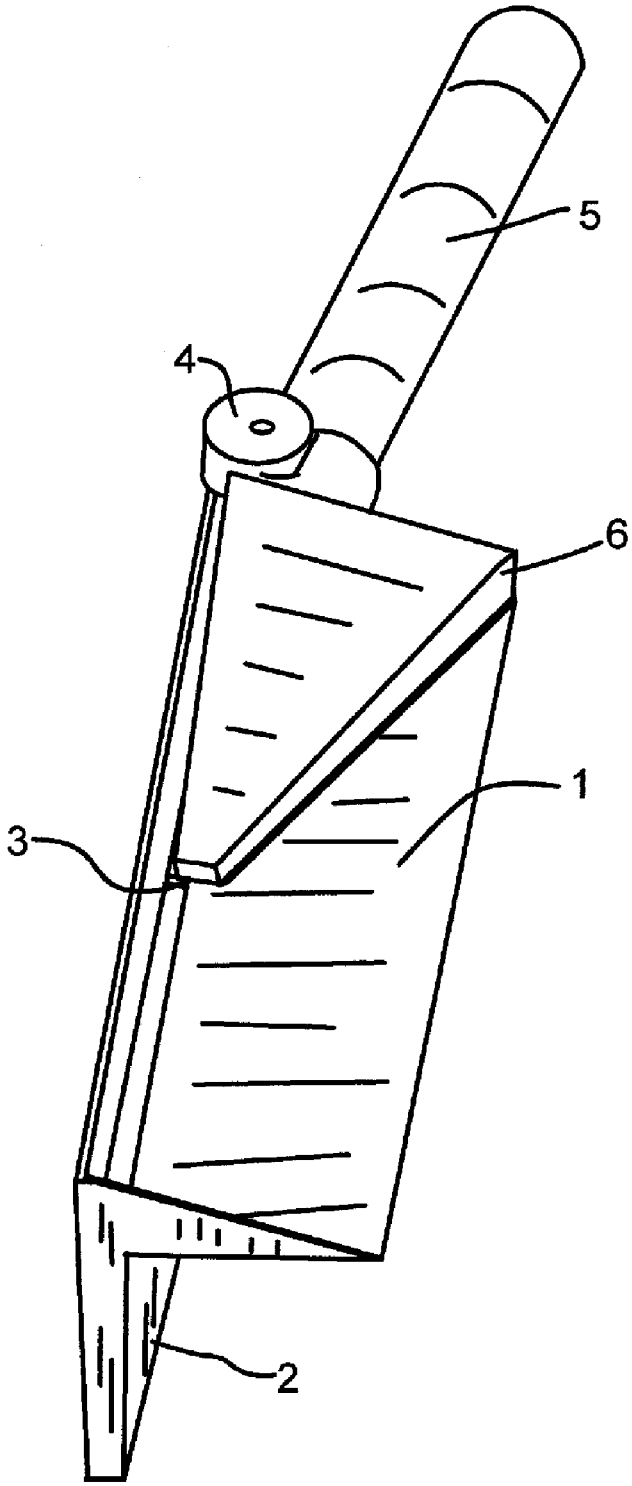
FIG. 1 shows a top view of an embodiment of the invention with the divider folded down.

Turning to FIG. 1, an embodiment of the present invention can be seen. A mini-hopper 1 is sized to hold the correct amount of mortar for the desired joint (vertical or horizontal). A sluiceway 2, is dimensioned to fill a block end. The distance from the handle end of the sluiceway 2 to the distal end should be the nominal width of the block (for vertical joints) (typically 4 or 8 inches). The width of the sluiceway 2 should be the nominal width of the joint (typically ⅜ inch). An optional divider 3 optionally divides the sluiceway 2 for 4 or 8 inch blocks. The divider 3 can simply be a thin partition. An optional hinged excluder 6 can be folded down to accommodate 4 inch blocks, and folded up to accommodate 8 inch blocks. It should be clear to one with skill in the art that any size blocks can be accommodated with different embodiments of the present invention by sizing it differently. It should also be clear that the divider 3 and excluder 6 can be removed from the invention if only one size block is desired.

A vibrator 4 in an optional casing can be connected to the sluiceway 2 or elsewhere so that the entire device (sluiceway and/or hopper) vibrates. A hand button or other switch can turn the vibrator on and off. A handle 5 can be solid or hollow. If hollow, it can contain batteries 7 (FIG. 3).

Figure 2:
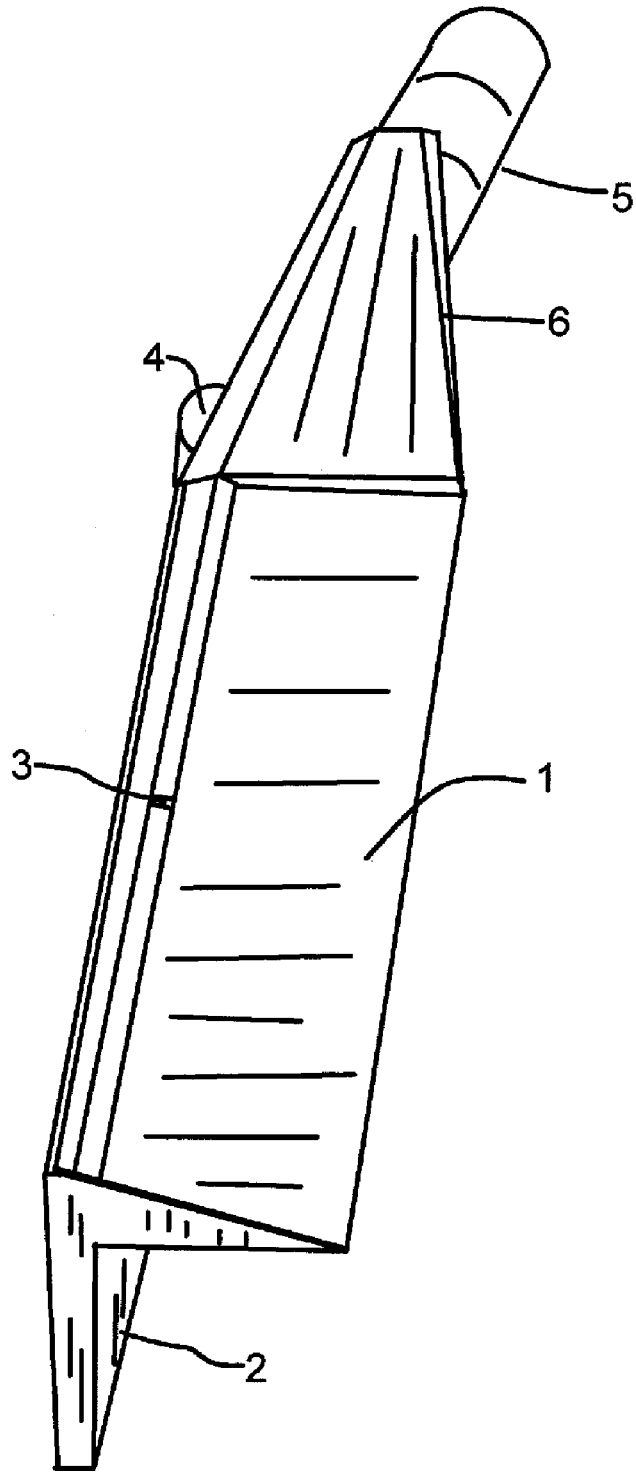
FIG. 2 shows the embodiment of FIG. 1 with the divider folded out.

FIG. 2 shows the embodiment of FIG. 1 with the hinged excluder 6 folded up (for 8 inch blocks). The sluiceway divider 3 can also be seen.

Figure 3:
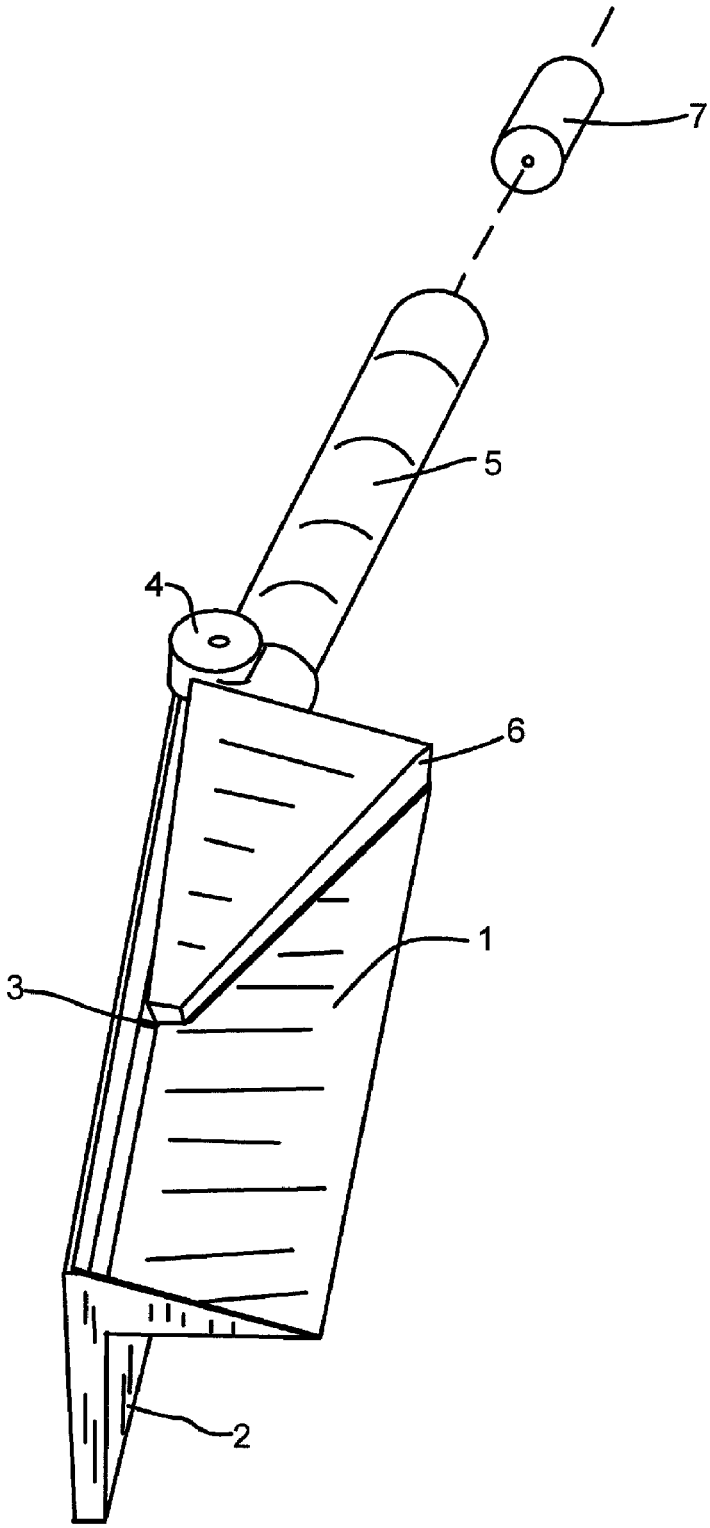
FIG. 3 shows the embodiment of FIG. 1 with an insertable battery.

FIG. 3 shows the embodiment of FIG. 1 with batteries 7 that can be placed inside a hollow embodiment of the handle 5. The number and types of batteries should be chosen to correctly drive the vibrator 4. Alternatively, the vibrator 4 can be driven by local power with a cord by being property adapted for line voltage. One with skill in the art will realize that batteries can be placed or attached anywhere convenient on the device.

In use, the correct amount of mortar can be scooped up while the tool is vibrating (by depressing the on/off button).

When full, the vibrator can be stopped while the tool is positioned to the face end of a block already set in its mortar bed. The block can then be pushed to the other face of the tool to make the joint the correct size. Once in place with the sluice between the blocks, the vibrator can again be started and the tool removed from the joint. This will leave exactly the right amount of mortar between the blocks. Protruding mortar can be cut off in the normal way, and the joint can be finished as desired. The entire process can be done with no more than four hand motions. The same tool can be used to butter horizontal joints by running the vibrator only sufficiently to apply the correct amount of mortar, or by using another similar embodiment of the invention, a vibratory tool having the length of an entire block and containing a measured amount of mortar.

The preferred material to make the present invention from is tempered steel; however, any type of steel or iron or any other rigid or semi-rigid material that will vibrate can be used including numerous types of hard polymers. The handle can be made from any rigid material. The vibrator typically runs on a DC voltage of 3-12 volts. As stated, the vibrator can also run on AC line voltage provided it is rated for the voltage and made safe using sufficient insulation and water penetration protection. Nevertheless, for safety reasons, low voltage is preferred. It should be understood, that the position of the handle is optional and generally positioned for maximum efficiency. One with skill in the art could see that several other configurations of how the handle can be placed in relation to hopper and sluice.

Several descriptions and illustrations have been presented to show the features of the present invention and to aid in understanding the invention. One with skill in the art will realize that numerous changes and variations can be made without departing from the spirit of the invention. Each of these changes and variations is within the scope of the present invention.

I claim:

1. A hand tool for laying concrete blocks comprising:

a hopper for holding a predetermined amount of mortar, said hopper containing an excluder that in a first position allows a correct amount of mortar for a first sized block and in a second position allows a correct amount of mortar for a second sized block;

a sluice communicating with said hopper, said sluice having a width approximately equal to a block-to-block distance in a vertical concrete block joint, said sluice having a length approximately equal to a concrete block width;

a vibrator mechanically coupled to said sluice or hopper;

whereby, said hopper can deliver said predetermined amount of mortar through said sluice into said joint by activating said vibrator.

2. The hand tool of claim 1 further comprising a divider in said sluice.

3. The hand tool of claim 1 further comprising an elongated approximately cylindrical handle attached to said hopper or sluice.

4. The hand tool of claim 1 wherein said hopper and sluice are made from tempered steel.

5. The hand tool of claim 1 wherein said vibrator is battery powered.

6. The hand tool of claim 3 wherein said vibrator is battery powered and said elongated handle contains at least one battery.

7. The hand tool of claim 1 wherein said vibrator is powered by line voltage.

8. A hand tool for laying 4 or 8 inch concrete blocks comprising:

a hopper capable of holding a correct amount of mortar for a standard ⅜ inch vertical concrete block joint for an 8 inch block;

a sluice in fluid communication with said hopper, said sluice having a width of around ⅜ inch and a length of around 8 inches;

a divider in said sluice dividing it into two 4 inch sluices;

a two-position excluder attached to said hopper wherein in a first position, said excluder allows a correct amount of mortar for a 4 inch block and in a second position, said excluder allows a correct amount of mortar for an 8 inch block;

a vibrator mechanically coupled to said hopper or sluice, said vibrator adapted to be activated by an operator.

9. The hand tool of claim 8 with an extended approximately cylindrical handle attached to said hopper or sluice.

10. The hand tool of claim 9 wherein said handle is hollow and contains a plurality of batteries for powering said vibrator.

11. The hand tool of claim 8 wherein said vibrator runs on line voltage.

12. The hand tool of claim 8 wherein said excluder is hinged and rotates from said first position to said second position.

13. The hand tool of claim 8 wherein said hopper and sluice are tempered steel.

14. A hand tool for laying concrete blocks comprising:

a hopper for holding a predetermined amount of mortar;

a sluice communicating with said hopper, said sluice having a width approximately equal to a block-to-block distance in a vertical concrete block joint, said sluice having a length approximately equal to a concrete block width;

a vibrator mechanically coupled to said sluice or hopper;

a divider in said sluice;

a removable excluder positionable in said hopper;

an elongated handle coupled to said hopper or sluice, said handle containing a plurality of batteries for powering said vibrator;

whereby, said hopper can deliver said predetermined amount of mortar through said sluice into said joint by activating said vibrator.

15. The hand tool of claim 14 wherein said hopper and sluice are tempered steel.

* * * * *